US006371865B1

(12) United States Patent
Magliulo

(10) Patent No.: US 6,371,865 B1
(45) Date of Patent: Apr. 16, 2002

(54) BRIEFCASE SYSTEM WITH GOLF CLUB AND METHOD OF FABRICATION

(76) Inventor: Louis Magliulo, 7310 Exter Way, Tampa, FL (US) 33615

( * ) Notice: Subject to any disclaimer, the term of this patent is extended or adjusted under 35 U.S.C. 154(b) by 0 days.

(21) Appl. No.: 09/517,918

(22) Filed: Mar. 3, 2000

(51) Int. Cl.[7] ..... A63B 69/36; A63B 53/16

(52) U.S. Cl. ..... 473/256; 473/296; 473/306; 473/288; 473/297; 473/409

(58) Field of Search ..... 473/296, 305, 473/306, 307, 316, 291, 292, 297, 409, 288, 219, 256; 280/823; 403/109.1, 109.4; 135/69, 75; 248/188.5; 15/144.3, 144.4

(56) References Cited

U.S. PATENT DOCUMENTS 1,650,183 A * 11/1927 Brooks
3,524,646 A * 8/1970 Wheeler
3,606,327 A * 9/1971 Gorman
4,600,195 A * 7/1986 Hunter
4,852,782 A * 8/1989 Wu
5,282,619 A * 2/1994 Napolitano
5,997,412 A * 12/1999 Benson
6,186,904 B1 * 2/2001 Bass

* cited by examiner

*Primary Examiner*—Sebastiano Passaniti

(57) ABSTRACT

A briefcase system has a first portion and a second portion with a hinge pivotally coupling the first and second portions. Each portion has walls in a rectilinear configuration forming a large chamber in the first portion and a small chamber in the second portion. A large block of resilient foam substantially fills the first portion and a small block of foam substantially fills the second portion. A plurality of discrete recesses are formed in the large block and in the small block. Each of the recesses extend inwardly from the open faces and are configured to receive a plurality of preselected golf related components. A plurality of preselected golf related components and accessories are located within the recesses of the blocks. Also disclosed is a variable weight/variable swing weight golf club and the method of fabrication.

6 Claims, 4 Drawing Sheets

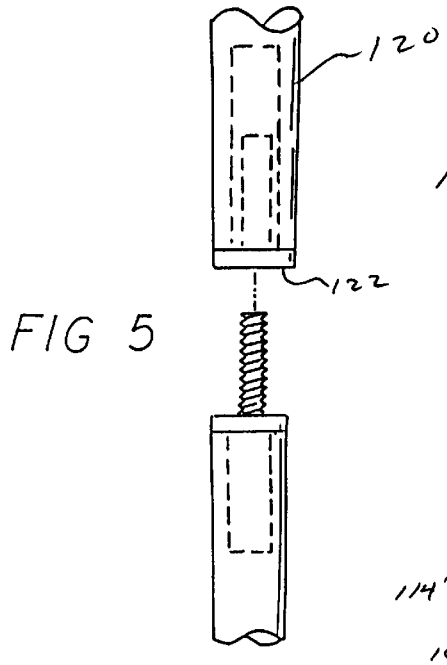
FIG 5
FIG 6
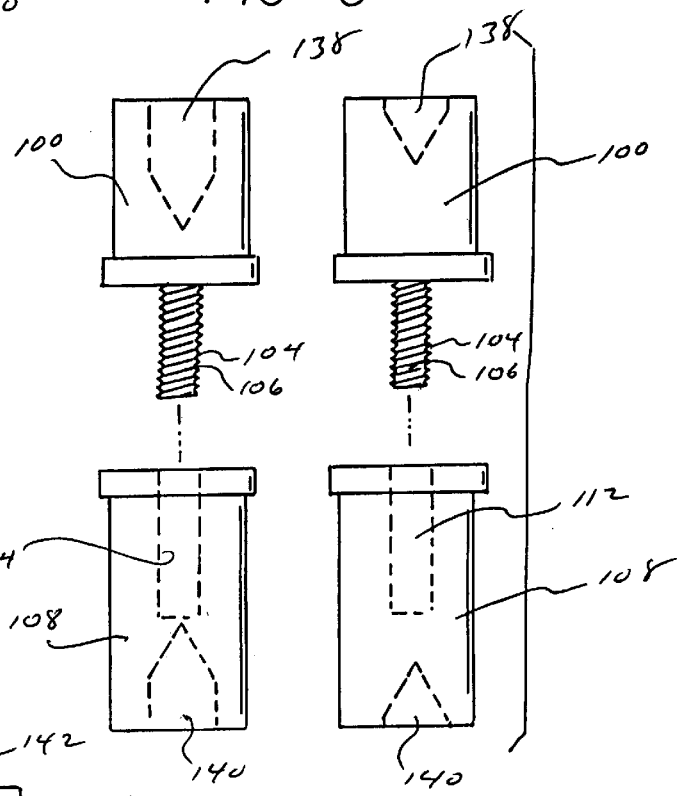
FIG 7
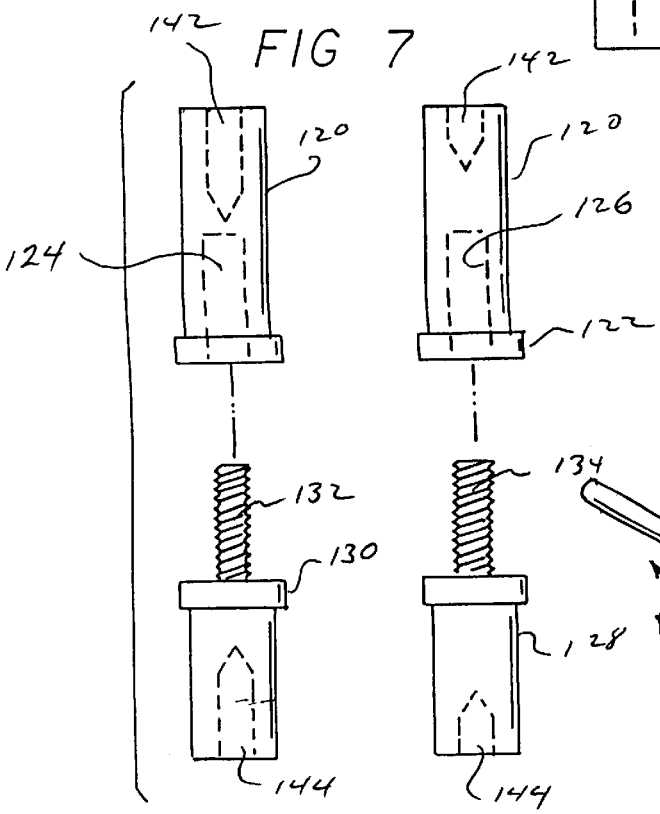
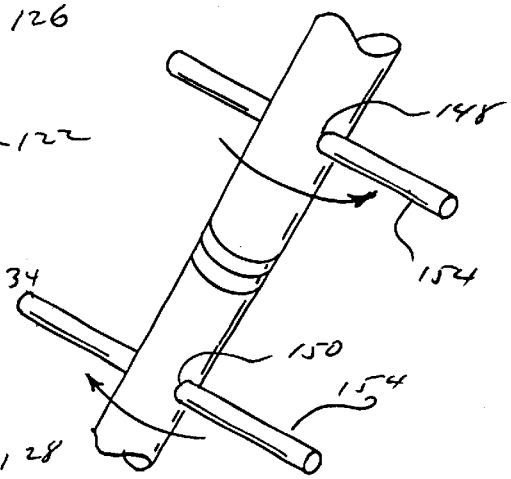
FIG 8

BRIEFCASE SYSTEM WITH GOLF CLUB AND METHOD OF FABRICATION

BACKGROUND OF THE INVENTION

1. Field of the Invention

The present invention relates to a briefcase system with golf club and method of fabrication and more particularly pertains to discreetly storing and transporting golf club components and accessories.

2. Description of the Prior Art

The use of golf equipment of known designs and configurations is known in the prior art. More specifically, golf equipment of known designs and configurations previously devised and utilized for the purpose of transporting, storing and fabricating golf related components by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,464,850 to P. G. Crawshaw discloses a sectional golf club shaft. U.S. Pat. No. 3,829,092 to Arkin discloses a set of golf clubs and means for carrying same. U.S. Pat. No. 3,848,737 to Kenon discloses a golf set. U.S. Pat. No. 4,106,597 to Shook et al. discloses an executive food carrying case. U.S. Pat. No. 4,280,700 to Plagenhoef discloses a golf club and golf club set. U.S. Pat. No. 4,340,227 to Dopkowski discloses a golf club set and carrying case. Lastly, U.S. Pat. No. 5,765,691 to Hall discloses a traveling golf set.

While these devices fulfill their respective, particular objectives and requirements, the aforementioned patents do not describe a briefcase system with golf club and method of fabrication that allows discreetly storing and transporting golf club components and accessories.

In this respect, the briefcase system with golf club and method of fabrication according to the present invention substantially departs from the conventional concepts and designs of the prior art, and in doing so provides an apparatus primarily developed for the purpose of discreetly storing and transporting golf club components and accessories.

Therefore, it can be appreciated that there exists a continuing need for a new and improved briefcase system with golf club and method of fabrication which can be used for discreetly storing and transporting golf club components and accessories. In this regard, the present invention substantially fulfills this need.

SUMMARY OF THE INVENTION

In view of the foregoing disadvantages inherent in the known types of golf equipment of known designs and configurations now present in the prior art, the present invention provides an improved briefcase system with golf club and method of fabrication. As such, the general purpose of the present invention, which will be described subsequently in greater detail, is to provide a new and improved briefcase system with golf club and method of fabrication and method which has all the advantages of the prior art and none of the disadvantages.

To attain this, the present invention essentially comprises a briefcase system which has a first portion and a second portion with a hinge pivotally coupling the first and second portions. Each portion has walls in a rectilinear configuration forming a large chamber in the first portion and a small chamber in the second portion. A large block of resilient foam substantially fills the first portion and a small block of foam substantially fills the second portion. A plurality of discrete recesses are formed in the large block and in the small block. Each of the recesses extends inwardly from the open faces and is configured to receive a plurality of preselected golf related components. A plurality of preselected golf related components and accessories are located within the recesses of the blocks. Further, a golf club system is included. The golf club system includes a hollow upper shaft component with an upper end and a lower end. A hollow lower shaft component has an upper end and a lower end. A hollow intermediate shaft component has an upper end and a lower end. An upper coupling assembly is adapted to separably couple the lower end of the upper shaft component and the upper end of the intermediate shaft component. A lower coupling assembly is provided and is adapted to separably couple the upper end of the lower shaft component and the lower end of the intermediate component. Recesses of a preselected depth extend into each of the assemblies to vary the weight and swing weight of the shaft components when coupled. Also included is the method of fabrication.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved briefcase system with golf club and method of fabrication which has all of the advantages of the prior art golf equipment of known designs and configurations and none of the disadvantages.

It is another object of the present invention to provide a new and improved briefcase system with golf club and method of fabrication which may be easily and efficiently manufactured and marketed.

It is a further object of the present invention to provide a new and improved briefcase system with golf club and method of fabrication which is of durable and reliable constructions.

An even further object of the present invention is to provide a new and improved briefcase system with golf club and method of fabrication which is susceptible of a low cost of manufacture with regard to both materials and labor, and which accordingly is then susceptible of low prices of sale to the consuming public, thereby making such briefcase system with golf club and method of fabrication economically available to the buying public.

Even still another object of the present invention is to provide a briefcase system with golf club and method of fabrication for discreetly storing and transporting golf club components and accessories.

Lastly, it is an object of the present invention to provide a new and improved briefcase system. The briefcase system has a first portion and a second portion with a hinge pivotally coupling the first and second portions. Each portion has walls in a rectilinear configuration forming a large chamber in the first portion and a small chamber in the second portion. A large block of resilient foam substantially fills the first portion and a small block of foam substantially fills the second portion. A plurality of discrete recesses are formed in the large block and in the small block. Each of the recesses extend inwardly from the open faces and are configured to receive a plurality of preselected golf related components. A plurality of preselected golf related components and accessories are located within the recesses of the blocks. Also disclosed is a variable weight/variable swing weight golf club and the method of fabrication.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an elevational view taken at circle 5 of FIG. 3.

FIG. 6 is a plurality of exploded showings of varying weights and swing weights of the coupling components shown in FIG. 4.

FIG. 7 is an elevational view of a plurality of the coupling components for varying weights and swing weights of the components shown in FIG. 5.

FIG. 8 is a perspective illustration of the rods for coupling and uncoupling the shaft components.

The same reference numerals refer to the same parts throughout the various Figures.

DESCRIPTION OF THE PREFERRED EMBODIMENT

Figure 1:
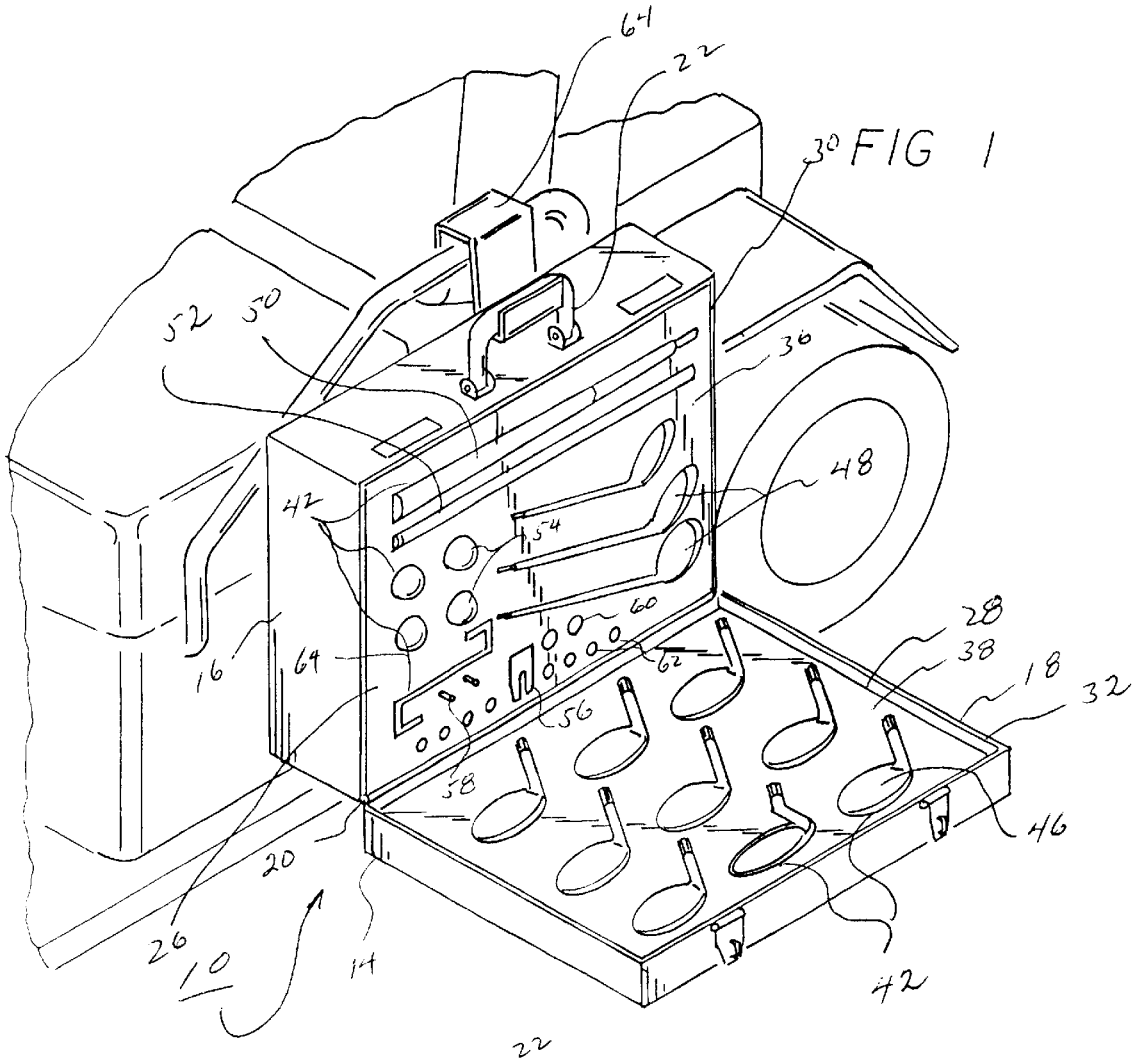
FIG. 1 is a perspective illustration of the new and improved briefcase system constructed in accordance with the principles of the present invention.
Figure 2:
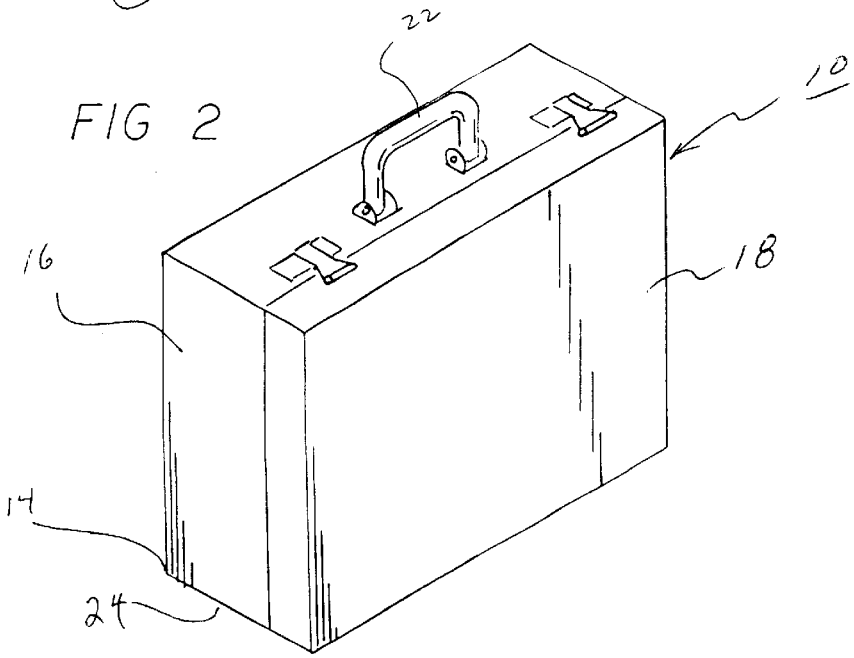
FIG. 2 is a perspective illustration of the briefcase shown in FIG. 1 but closed for transportation and storage.
Figure 3:
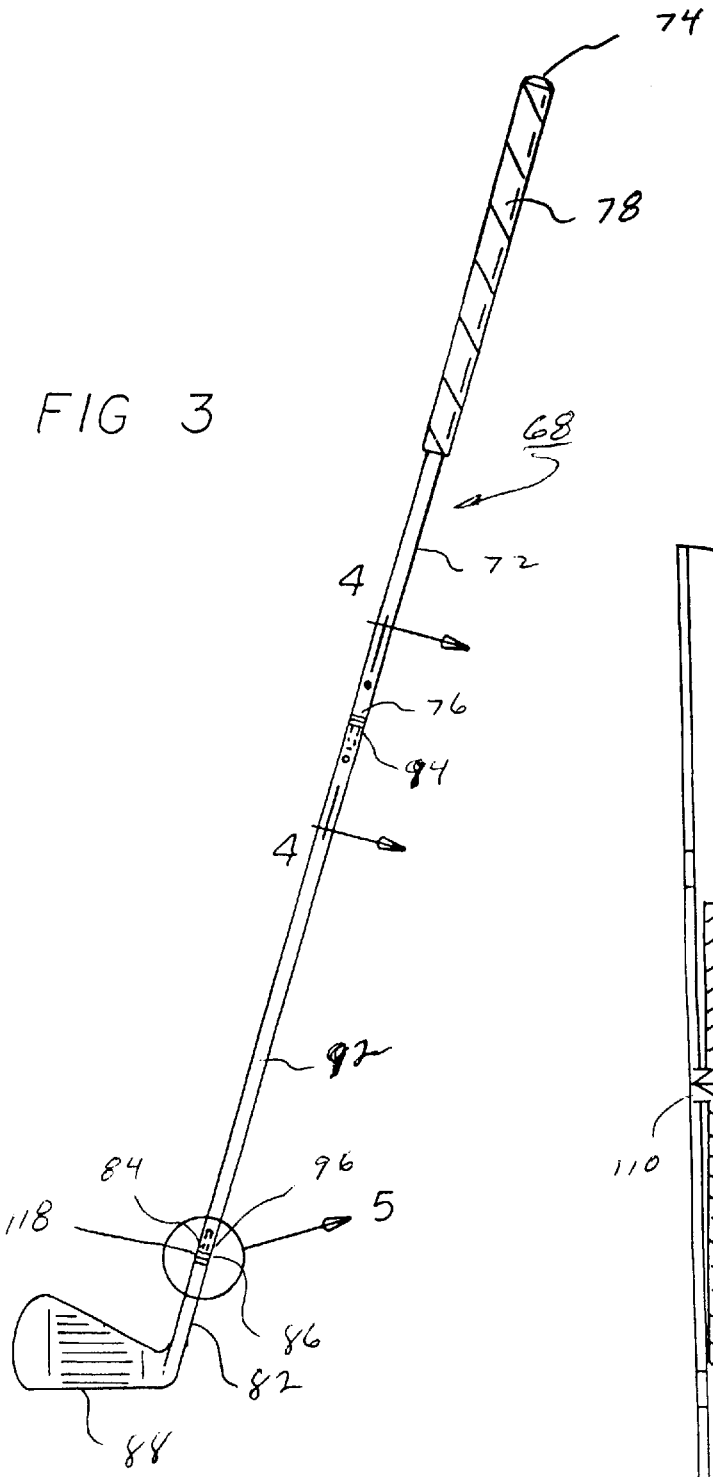
FIG. 3 is a front elevational view of an assembled golf club constructed from selected components shown in FIG. 1.
Figure 4:
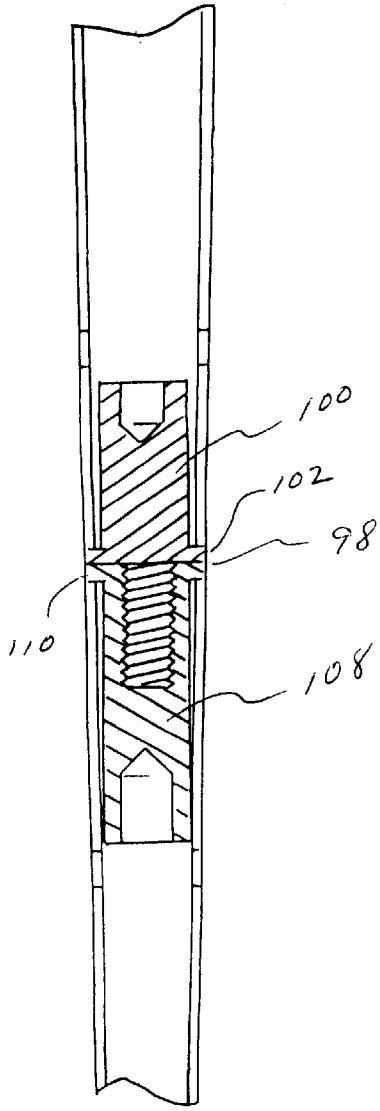
FIG. 4 is an enlarged cross sectional view taken along line 4—4 of FIG. 3.
Figure 9:
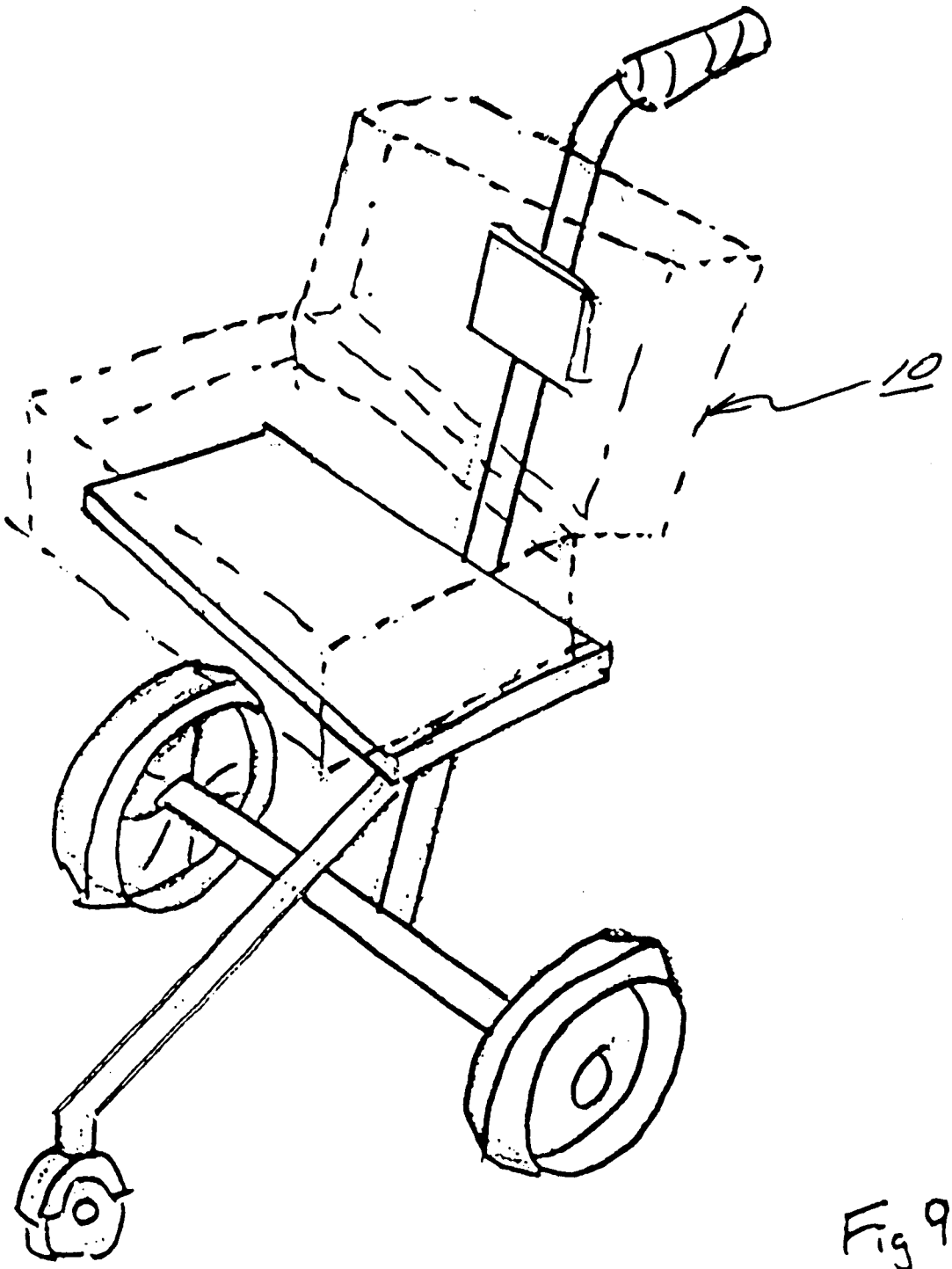
FIG. 9 is a perspective illustration similar to FIG. 1 but illustrating the device mounted on a pull-type golf cart.

With reference now to the drawings, and in particular to FIG. 1 thereof, the preferred embodiment of the new and improved briefcase system with golf club and method of fabrication embodying the principles and concepts of the present invention and generally designated by the reference numeral 10 will be described.

The present invention, the briefcase system with golf club and method of fabrication 10 is comprised of a plurality of components. Such components in their broadest context include a briefcase with large and small blocks of resilient foam with a plurality of discreet recesses, a plurality of preselected golf related components, a golf club system with a hollow upper shaft component, a hollow lower shaft component, a hollow intermediate shaft component, an upper coupling assembly and a lower coupling assembly, and recesses extending into each of the assemblies, and the method of fabrication. Such components are individually configured and correlated with respect to each other so as to attain the desired objective.

A new and improved briefcase system 10 for discreetly storing and transporting golf club components and accessories includes a briefcase 14. The briefcase has a first portion 16 of an enlarged size. The briefcase also has a second portion 18 of a reduced size. A hinge 20 pivotally couples the first and second portions for movement between an open orientation and a closed orientation. The briefcase has a handle 22 on the first portion remote from the hinge. Each portion has walls 24 in a rectilinear configuration forming a large chamber 26 in the first portion and a small chamber 28 in the second portion. Each portion has an open face 30, 32. The open faces are in parallel facing contact when the briefcase is closed for transportation and storage purposes. The hinge allows the open faces to reside at 90 degrees with respect to each other during operation and use. A large block 36 of resilient foam substantially fills the first portion. A small block 38 of foam substantially fills the second portion. A plurality of discrete recesses 42 are formed in the large block and in the small block. Each of the recesses extends inwardly from the open faces. The recesses are sized and configured to receive a plurality of preselected golf related components. A plurality of preselected golf related components and accessories are located within the recesses of the blocks. The golf related components include nine iron heads 46, three wood heads 48, two shaft halves 50, 52, four balls 54, one turf repairer 56, two turning rods 58, one ball marker 60, ten tees 62, and one hook 64 for coupling to a motorized golf cart and in the alternative to a golf pull cart.

Next provided is a new and improved golf club system 68. The golf club system has separable components and variable weight and swing weight. The system includes a hollow upper shaft component 72. The upper shaft component has an upper end 74 and a lower end 76. A grip 78 is provided and is located around the upper end for being held by a user during operation and use. A hollow lower shaft component 82 is next provided. The lower shaft component has an upper end 84 and a lower end 86. A club head 88 is provided at the lower end of the lower shaft component. A hollow intermediate shaft component 92 is provided. The intermediate shaft component has an upper end 94 and a lower end 96. Next provided is an upper coupling assembly 98. The upper coupling assembly is adapted to separably couple the lower end of the upper shaft component and the upper end of the intermediate shaft component. The upper coupling assembly has an upper cylindrical element 100 positioned within the upper shaft component with a radially enlarged shoulder 102 extending to a distance essentially equal to the exterior diameter of the upper shaft component. A downwardly extending member 104 is provided with left handed screw threads 106. A lower cylindrical element 108 is positioned within the intermediate shaft component with a radially enlarged shoulder 110 extending to a distance essentially equal to the exterior diameter of the intermediate shaft component. A downwardly extending recess 112 is provided. The downwardly extending recess is provided with left handed screw threads 114 for receiving the threads of the upper element. A lower coupling assembly 118 is provided. The lower coupling assembly is adapted to separably couple the upper end of the lower shaft component and the lower end of the intermediate shaft component. The lower coupling assembly has an upper cylindrical element 120 positioned within the intermediate shaft component. The lower coupling assembly also has a radially enlarged shoulder 122 extending to a distance essentially equal to the diameter of the lower shaft component. An upwardly extending recess 124 has left handed screw threads 126 thereon. A lower cylindrical element 128 is positioned within the lower shaft component. A radially enlarged shoulder 130 extends to a distance essentially equal to the exterior diameter of the lower shaft component. Next provided is an upwardly extending member 132 with left handed screw threads 134 to receive the threads of the upper element. The above described left handed screw threads are for right handed golfers. The various screw threads as described above are opposite for left handed golfers. Recesses 138, 140, 142, 144 of a preselected depth are provided. The recesses extend into each of the elements and function to vary the weight and swing weight of the shaft components when coupled. Next provided are apertures 148, 150. Apertures 148 extend through the upper shaft component and intermediate shaft component adjacent to the upper coupling assembly. Apertures 150 extend through the lower shaft component and intermediate shaft component adjacent to the lower coupling assembly. A pair of rods 154 are provided. The rods are positionable within the apertures to allow for the rotation of the shaft components with respect to each other for coupling and uncoupling purposes.

Next provided is a new and improved method for fabricating a golf club system 68 with separable components and variable weight and swing weight. The method includes providing a hollow upper shaft component 72. The upper shaft component has an upper end 74 and a lower end 76. A grip 78 is provided and is located around the upper end of the upper shaft component. The grip is provided to be held by a user during operation and use. The method further includes providing a hollow lower shaft component 82. The lower shaft component has an upper end 84 and a lower end 86. A club head 88 is provided at the lower end of the lower shaft component. The method further includes providing a hollow intermediate shaft component 92. The intermediate shaft component has an upper end 94 and a lower end 96. The method further includes providing an upper coupling assembly 98. The upper coupling assembly is adapted to separably couple the lower end of the upper shaft component and the upper end of the intermediate shaft component. The upper coupling assembly has an upper cylindrical element 100 positioned within the upper shaft component with a radially enlarged shoulder 102 extending to a distance essentially equal to the exterior diameter of the upper shaft component. A downwardly extending member 104 is provided with left handed screw threads 106. A lower cylindrical element 108 is positioned within the intermediate shaft component with a radially enlarged shoulder 110 extending to a distance essentially equal to the exterior diameter of the intermediate shaft component. A downwardly extending recess 112 is provided with left handed screw threads 114 receiving the threads of the upper element. The method further includes providing a lower coupling assembly 118. The lower coupling assembly is adapted to separably couple the upper end of the lower shaft component and the lower end of the intermediate shaft component. The lower coupling assembly has an upper cylindrical element 120 positioned within the intermediate shaft component. The lower coupling assembly also has a radially enlarged shoulder 122 extending to a distance essentially equal to the diameter of the lower shaft component. An upwardly extending recess 124 has left handed screw threads 126 thereon. A lower cylindrical element 128 is positioned within the lower shaft component. A radially enlarged shoulder 130 extends to a distance essentially equal to the exterior diameter of the lower shaft component. An upwardly extending member 132 with left handed screw threads 134 receives the threads of the upper element. The above described left handed screw threads are for right handed golfers. The various screw threads as described above are opposite for left handed golfers. The method further includes forming recesses 138, 140, 142, 144 of a preselected depth extending into each of the elements. The recesses function to vary the weight and swing weight of the shaft components when coupled. The method further includes providing apertures 148, 150. Apertures 148 extend through the upper shaft component and intermediate shaft component adjacent to the upper coupling assembly. Apertures 150 extend through the lower shaft component and intermediate shaft component adjacent to the lower coupling assembly. The method also includes providing a pair of rods 154. The rods are positionable within the apertures to allow for the rotation of the shaft components with respect to each other for coupling and uncoupling purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf club system comprising:

a hollow upper shaft component with an upper end and a lower end;

a hollow lower shaft component with an upper end and a lower end;

a hollow intermediate shaft component with an upper end and a lower end;

an upper coupling assembly adapted to separably couple the lower end of the upper shaft component and the upper end of the intermediate shaft component;

a lower coupling assembly adapted to separably couple the upper end of the lower shaft component and the lower end of the intermediate component; and recesses of a preselected depth extending into each of the assemblies to vary the weight and swing weight of the shaft components when coupled.

2. The system as set forth in claim 1 wherein the upper coupling assembly further includes an upper cylindrical element positioned within the upper shaft component with a radially enlarged shoulder extending to a distance essentially equal to the exterior diameter of the upper shaft component and with a downwardly extending member with screw threads and a lower cylindrical element positioned within the intermediate shaft component with a radially enlarged shoulder extending to a distance essentially equal to the exterior diameter of the intermediate shaft component and with a downwardly extending recess with screw threads receiving the threads of the upper element.

3. The system as set forth in claim 1 and further including a lower coupling assembly adapted to separably couple the upper end of the lower shaft component and the lower end of the intermediate shaft component, the lower coupling assembly having an upper cylindrical element positioned within the intermediate shaft component and a radially enlarged shoulder extending to a distance essentially equal to the diameter of the lower shaft component and with an upwardly extending recess with screw threads thereon and lower cylindrical element positioned within the lower shaft component with a radially enlarged shoulder extending to a distance essentially equal to the exterior diameter of the lower shaft component and with an upwardly extending member with screw threads receiving the threads of the upper element.

4. The system as set forth in claim 1, and further including apertures extending through the upper shaft component and intermediate shaft component adjacent to the upper coupling assembly and apertures extending through the lower shaft component and intermediate shaft component adjacent to the lower coupling assembly and a pair of rods positionable within the apertures to allow for the rotation of the shaft components with respect to each other for coupling and uncoupling purposes.

5. A golf club fabrication method for, to fabricating a golf club system with separable components and with variable weight and swing weight comprising, in combination:

providing a hollow upper shaft component with an upper end and a lower end and with a grip around the upper end for being held by a user during operation and use;

providing a hollow lower shaft component with an upper end and a lower end and with a club head at the lower end;

providing a hollow intermediate shaft component with an upper end and a lower end;

providing an upper coupling assembly adapted to separably couple the lower end of the upper shaft component and the upper end of the intermediate shaft component, the upper coupling assembly having an upper cylindrical element positioned within the upper shaft component with a radially enlarged shoulder extending to a distance essentially equal to the exterior diameter of the upper shaft component and with a downwardly extending member with screw threads and a lower cylindrical element positioned within the intermediate shaft component with a radially enlarged shoulder extending to a distance essentially equal to the exterior diameter of the intermediate shaft component and with a downwardly extending recess with screw threads receiving the threads of the upper element;

providing a lower coupling assembly adapted to separably couple the upper end of the lower shaft component and the lower end of the intermediate shaft component, the lower coupling assembly having an upper cylindrical element positioned within the intermediate shaft component and a radially enlarged shoulder extending to a distance essentially equal to the diameter of the lower shaft component and with an upwardly extending recess with screw threads thereon and lower cylindrical element positioned within the lower shaft component with a radially enlarged shoulder extending to a distance essentially equal to the exterior diameter of the lower shaft component and with an upwardly extending member with screw threads receiving the threads of the upper element; and forming recesses of a preselected depth extending into each of the elements to vary the weight and swing weight of the shaft components when coupled.

6. The method as set forth in claim 3 and further including providing apertures extending through the upper shaft component and intermediate shaft component adjacent to the upper coupling assembly and apertures extending through the lower shaft component and intermediate shaft component adjacent to the lower coupling assembly and a pair of rods positionable within the apertures to allow for the rotation of the shaft components with respect to each other for coupling and uncoupling purposes.

* * * * *